US007371121B1

(12) United States Patent
Lee

(10) Patent No.: US 7,371,121 B1
(45) Date of Patent: May 13, 2008

(54) MULTIPLE ELECTRICAL OUTLET

(75) Inventor: Dominic Kan Nam Lee, Hong Kong (CN)

(73) Assignee: Multiway Industries Ltd., Hong Kong (CN)

( * ) Notice: Subject to any disclaimer, the term of this patent is extended or adjusted under 35 U.S.C. 154(b) by 26 days.

(21) Appl. No.: 11/243,119

(22) Filed: Oct. 4, 2005

(51) Int. Cl.
*H01R 25/00* (2006.01)

(52) U.S. Cl. ..... 439/650

(58) Field of Classification Search ..... 439/650, 439/651, 652, 654, 490, 107
See application file for complete search history.

(56) References Cited

U.S. PATENT DOCUMENTS 4,764,128 A * 8/1988 Cheng ..... 439/652
5,207,594 A * 5/1993 Olson ..... 439/490
5,443,400 A * 8/1995 Brown et al. ..... 439/650

* cited by examiner

*Primary Examiner*—Phuong Dinh
(74) *Attorney, Agent, or Firm*—Frost Brown Todd LLC

(57) ABSTRACT

The present invention teaches a unique unitary "fan type" electrical extension cord outlet structure having multiple electrical outlet stations wherein each outlet station includes a separate terminal connector assembly. Each connector assembly typically includes two spade type electrode connectors and one pin type electrode connector for receiving therein a male type electrical plug. Optionally, illuminating lamps may be embodied within each terminal connector and/or the main body of the "fan type" electrical outlet that illuminate when the extension cord is powered.

6 Claims, 11 Drawing Sheets

MULTIPLE ELECTRICAL OUTLET

BACKGROUND OF THE PRESENT INVENTION

The present invention generally relates to an electrical extension cord. More specifically the present invention teaches a molded, one piece, multiple electrical outlet wherein there is no distance, angular restriction, or other orientation restriction affecting the positioning of one electrical outlet with respect to the outer electrical outlets.

PRIOR ART

In a typical "fan type" extension cord outlet, of the prior art, the outlet connector stations are positioned adjacent one another, "side by side," whereby each outlet connector station shares a common, internally embedded, electrode, or bus, assembly.

By the prior art structure the distance between the associated electrical outlet stations, and the overall orientation of those stations, with respect to one another, is greatly restricted. Because of this restriction all of the electrical outlets provided may not simultaneously accommodate an electrical plug, particularly in a "fan type" connector where three or more adjacent electrical outlets are provided.

FIG. 1 illustrates a typical "fan type" extension cord electrical outlet 1 of the prior art. As illustrated, and because of the restrictiveness of the electrical outlet stations, male plugs 2 and 3 interfere with the full insertion of plug 4. Thus center plug 4 cannot be fully inserted into the center outlet station whereby the male electrodes 5, of plug 4, are exposed creating a possible "electrical shock" condition.

SUMMARY OF THE PRESENT INVENTION

The present invention overcomes the restrictive nature of the prior art internal electrode structure by providing each electrical outlet with a separately formed, terminal connector assembly separate and completely independent from each other. By this novel construction each electrical outlet terminal connector assembly may be positioned and/or oriented, with respect to the other electrical outlet terminal connector assemblies, without induced restrictions caused by the positioning of other electrical terminal connectors. Thus a new freedom of design and structuring of multiple extension cord electrical outlets is realized. Further, by this novel electrical cord outlet construction one or more miniature, low amperage neon lamps may be conveniently embedded within the internal structure that will illuminate when the extension cord is in use whereby the user of the extension cord readily knows that the extension cord is powered.

DETAILED DESCRIPTION OF THE INVENTION

Figure 1:
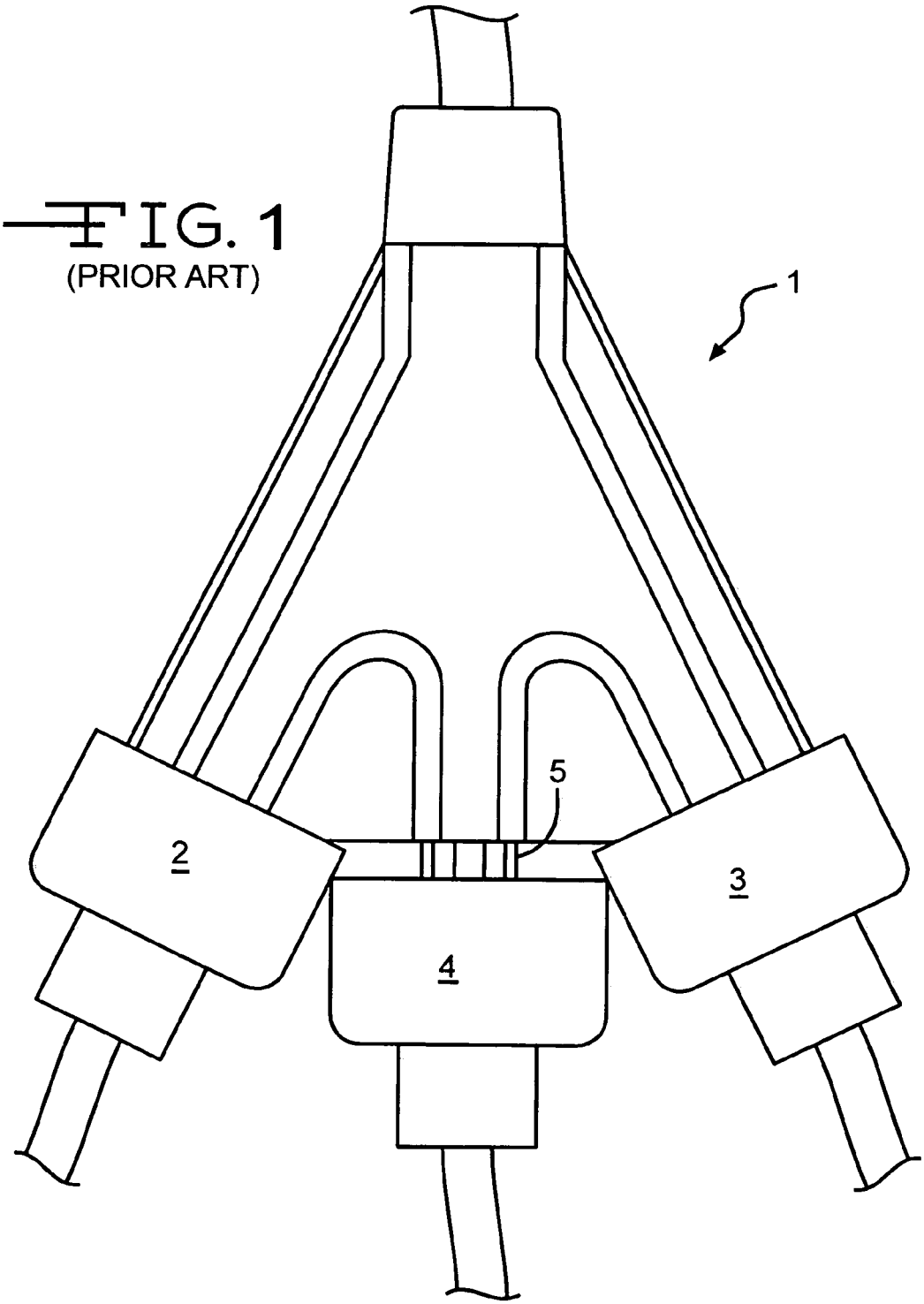
FIG. 1 (PRIOR ART)
FIG. 1 presents a typical top, plan view of a "fan type" extension cord, multiple electrical outlet of the prior art.
Figure 2:
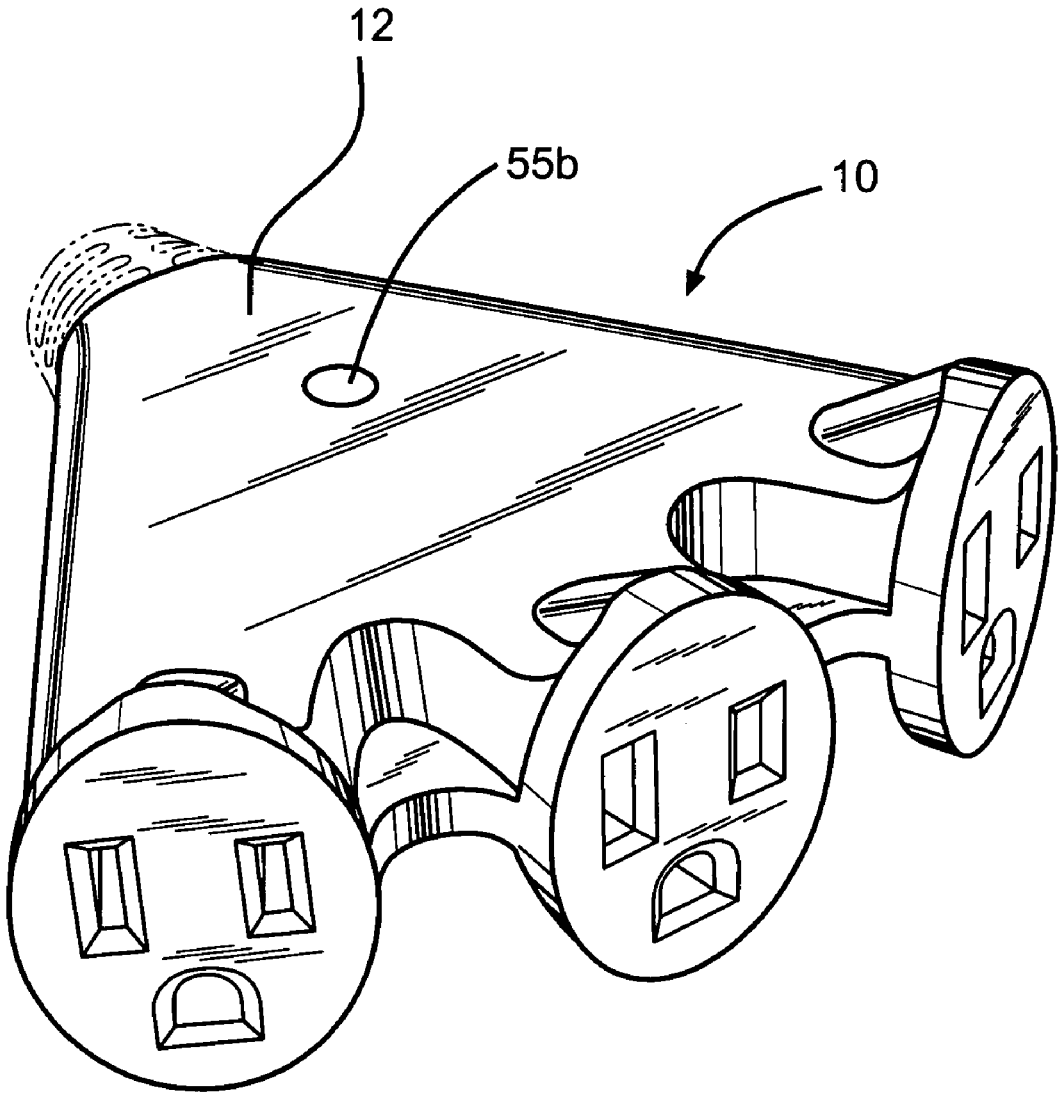
FIG. 2 presents a top pictorial view of a "fan type" extension cord, multiple electrical outlet embodying the present invention.

FIG. 2 presents a pictorial illustration of a three way, "fan type" extension cord multiple outlet assembly 10 typically used on electrical cord extensions. Although three electrical outlets are illustrated, multiple outlet assembly 10 may include any number of electrical outlet connectors. Multiple outlet assembly 10 typically comprises an internal wiring assembly encompassed within a molded elastomeric or resinous material 12 as illustrated.

Figure 3:
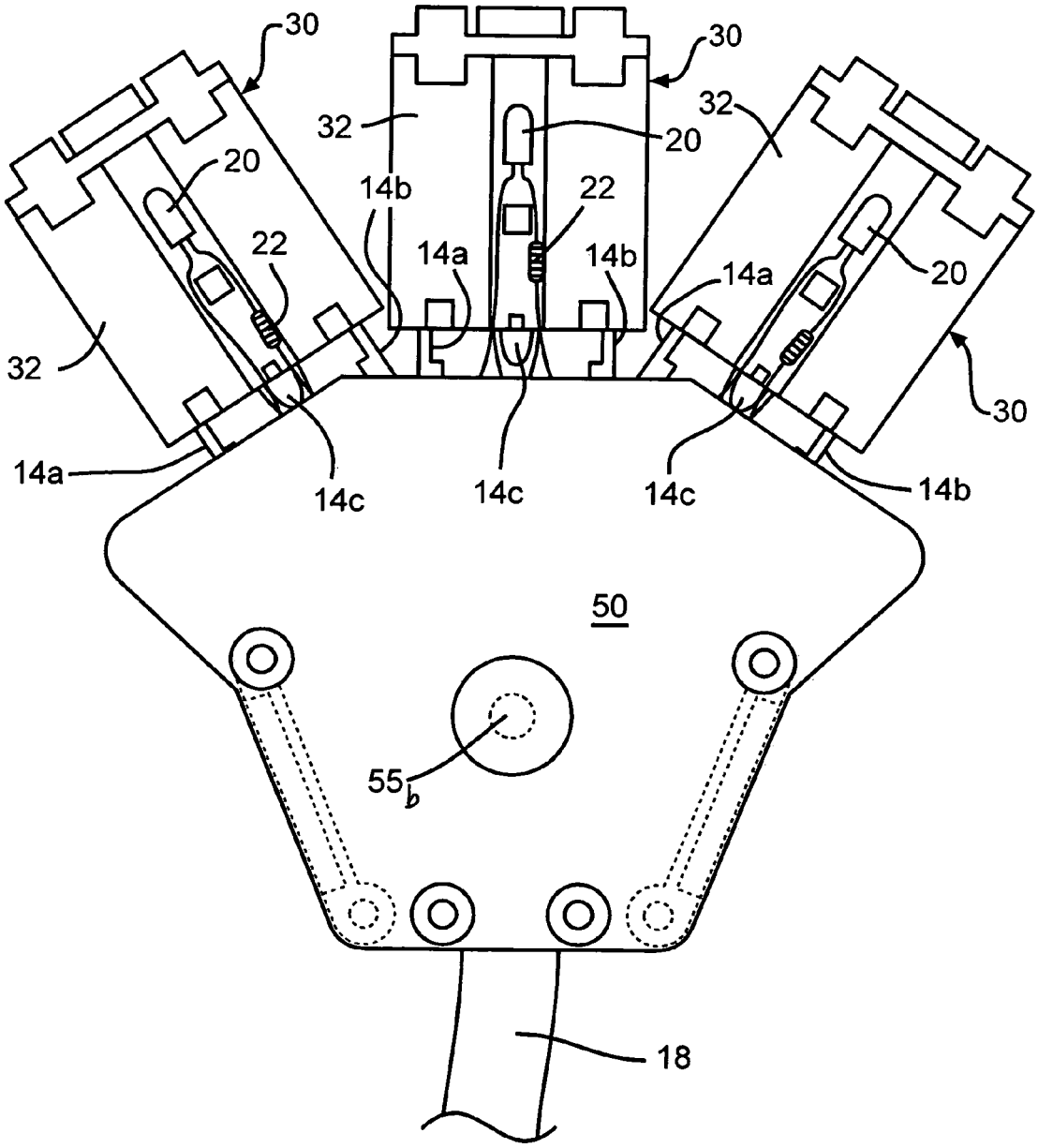
FIG. 3 presents a top plan view of the principal internal elements of the multiple electrical outlet of FIG. 2 with the external molded material removed.
Figure 4:
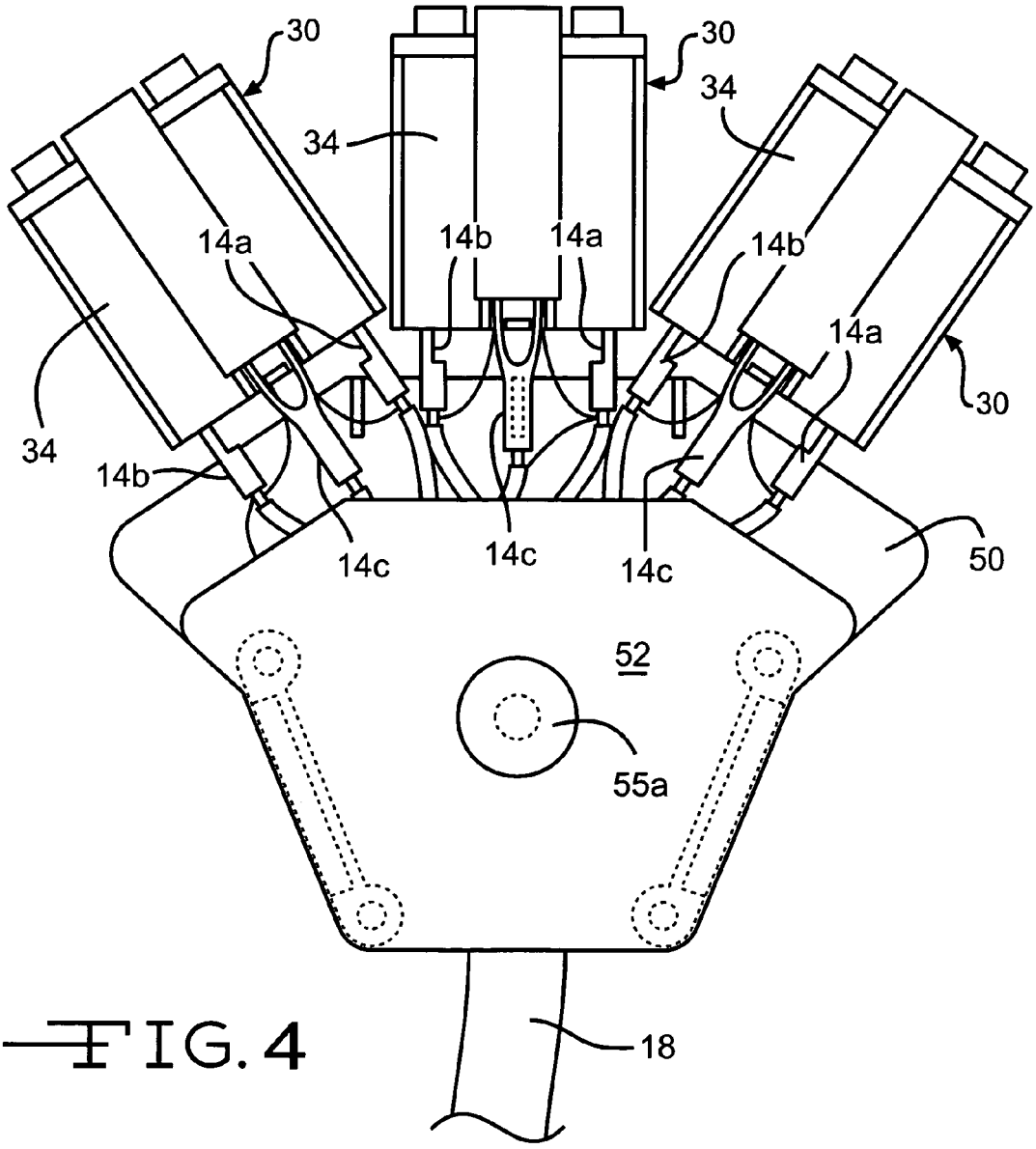
FIG. 4 presents a bottom view of the principal internal elements of the multiple electrical outlet of FIG. 2 with the external molded material removed.
Figure 5:
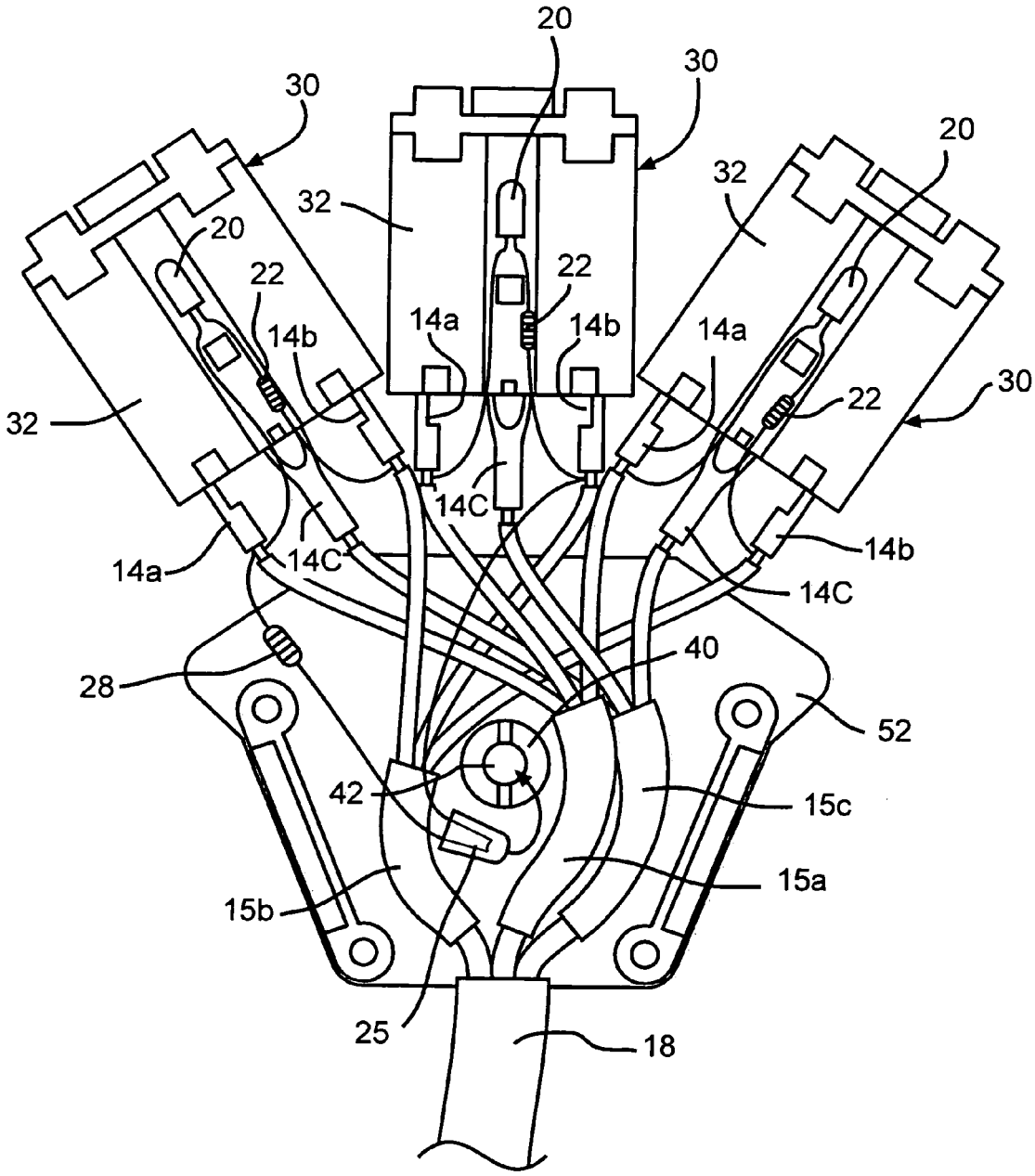
FIG. 5 presents a top view, similar to FIG. 3, of the, multiple electrical outlet internal elements with the top cover plate removed to more clearly show the internal wiring arrangement of the three way electrical outlet shown in FIG. 3.
Figure 6:
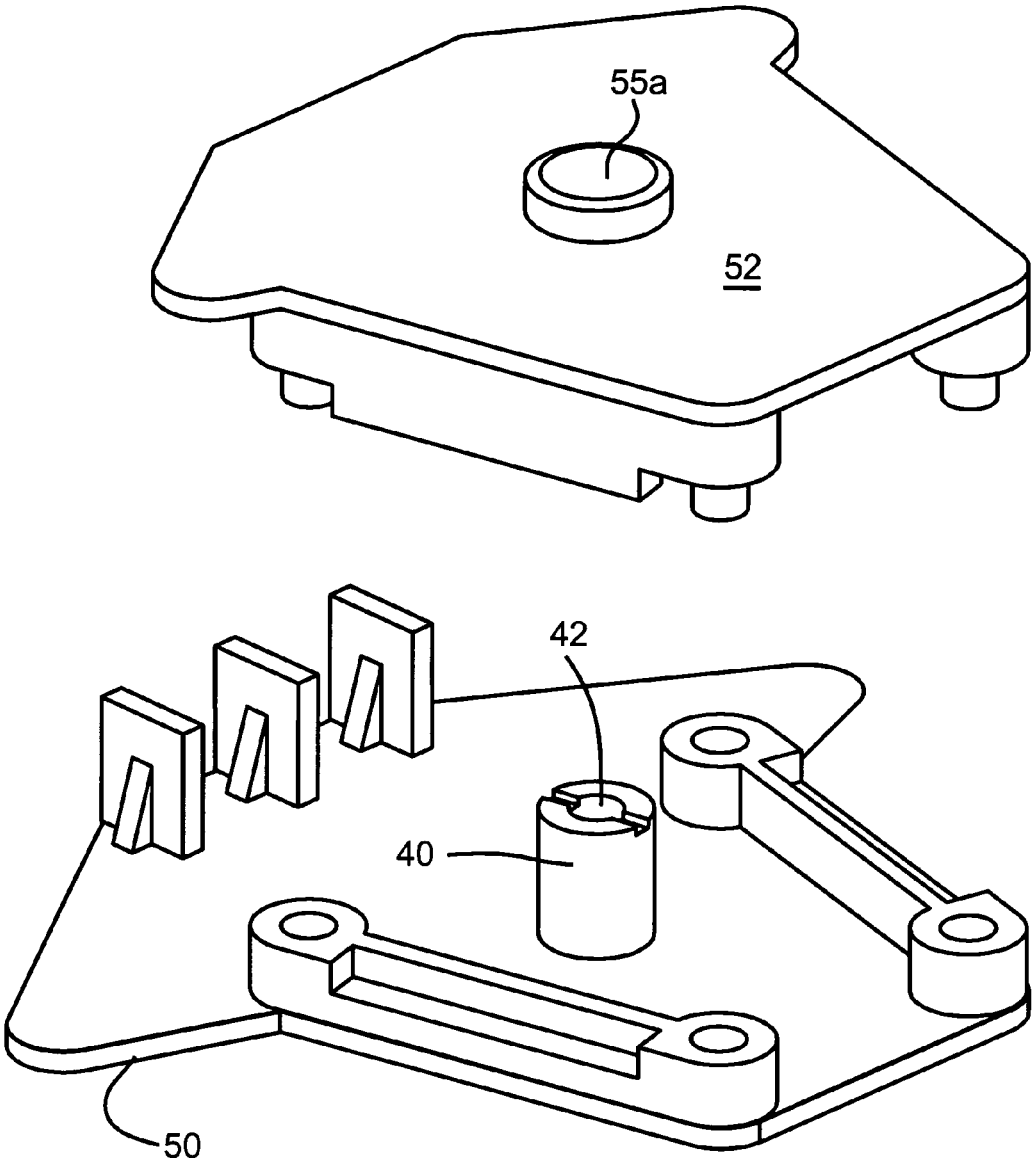
FIG. 6 presents an exploded pictorial showing the top and bottom cover plates with all other elements removed for clarity.
Figure 7:
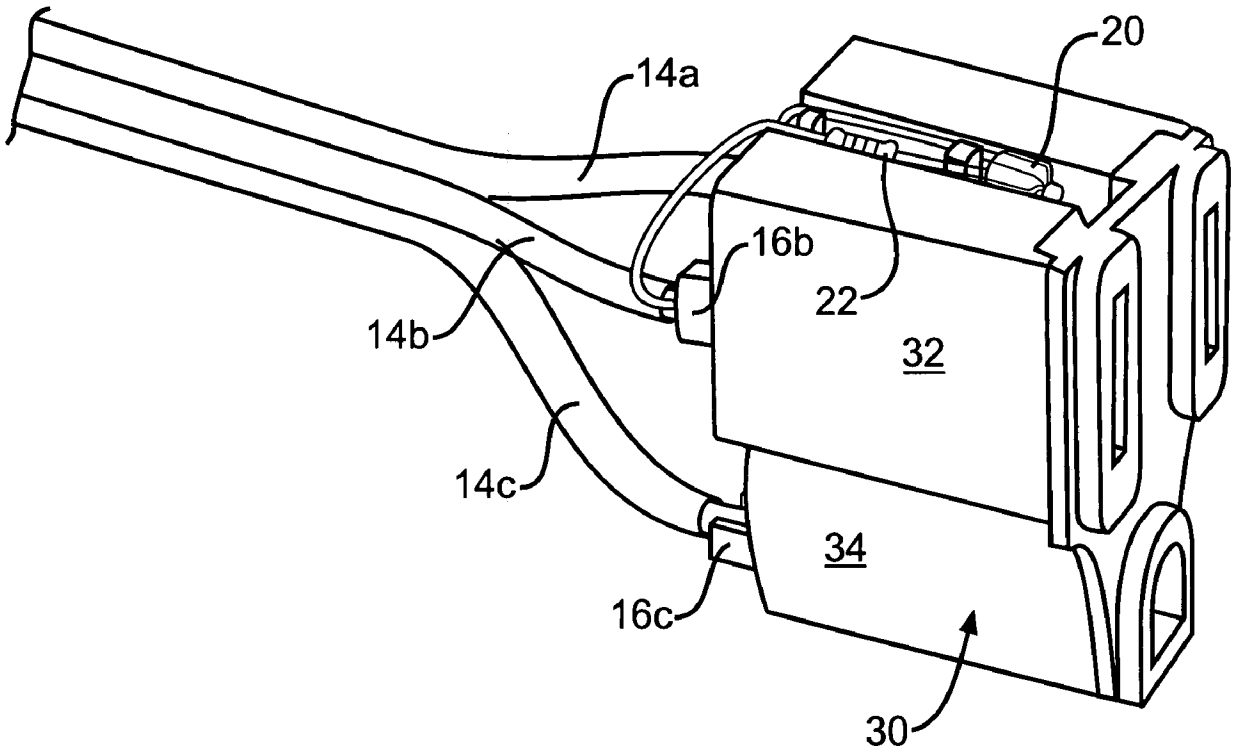
FIG. 7 presents a isolated pictorial view of one electrical outlet connector assembly.

FIGS. 3 and 4 illustrate top and bottom views of the principal internal elements of multiple outlet assembly 10 with the molded elastomeric covering 12 removed. As seen in the figures, each electrical outlet comprises a separate connector assembly 30 individually wired to the main extension cord 18 as best illustrated in FIG. 5. FIG. 7 presents a pictorial illustration of a single connector assembly 30. Each electrical outlet connector assembly 30 typically contains three electrically "hook-up" wire; hot wire 14*a*, common wire 14*b*, and ground wire 14*c*. Hook-up wires 14*a*, 14*b*, and 14*c* are connected to the main extension cord 18 by way of junctions 15*a*, 15*b* and 15*c*.

As illustrated in FIGS. 3 through 6, an upper plate 50 and its associated lower plate 52 are provided to secure the wiring, and connector assemblies 30 in place during the final steps in manufacturing. Upper and lower plates 50 and 52 are adhesively secured to each other or may be secured to each other by any other suitable means. Positioned in the approximate center of upper and lower plates 50 and 52 is post 40 having a center bore 42 extending therethrough and continuing through upper and lower plates 50 and 52.

In an embodiment wherein the molded body 12 comprises a transparent or translucent material small neon lamps 20 may be placed within the top surface of each connector assembly 30 along with an associated electrical resister 22 as described in further detail below. Further an additional neon lamp 25 and its associated electrical resister 28 may be positioned within bore 42 of post 40 as also described further below. Neon lamp 25 would be particularly used where the molded body 12 comprised an opaque material and individual lamps 20 were omitted.

Referring now to FIGS. 7 through 17, attached to wires 14*a*, 14*b*, and 14*c* are connector electrodes 16*a*, 16*b*, and 16*c* which, in turn, are retained within channels 36*a*, 36*b*, and 36*c* of the upper portion 32 of connector assembly 30. Connector electrodes 16*a*, and 16*b*, are typical spade type connectors while connector electrode 16*c* is a typical pin type electrode. Connector electrodes 16*a*, 16*b*, and 16*c* typically receive therein the hot, common, and ground terminals of an inserted male electrical plug.

Figure 8:
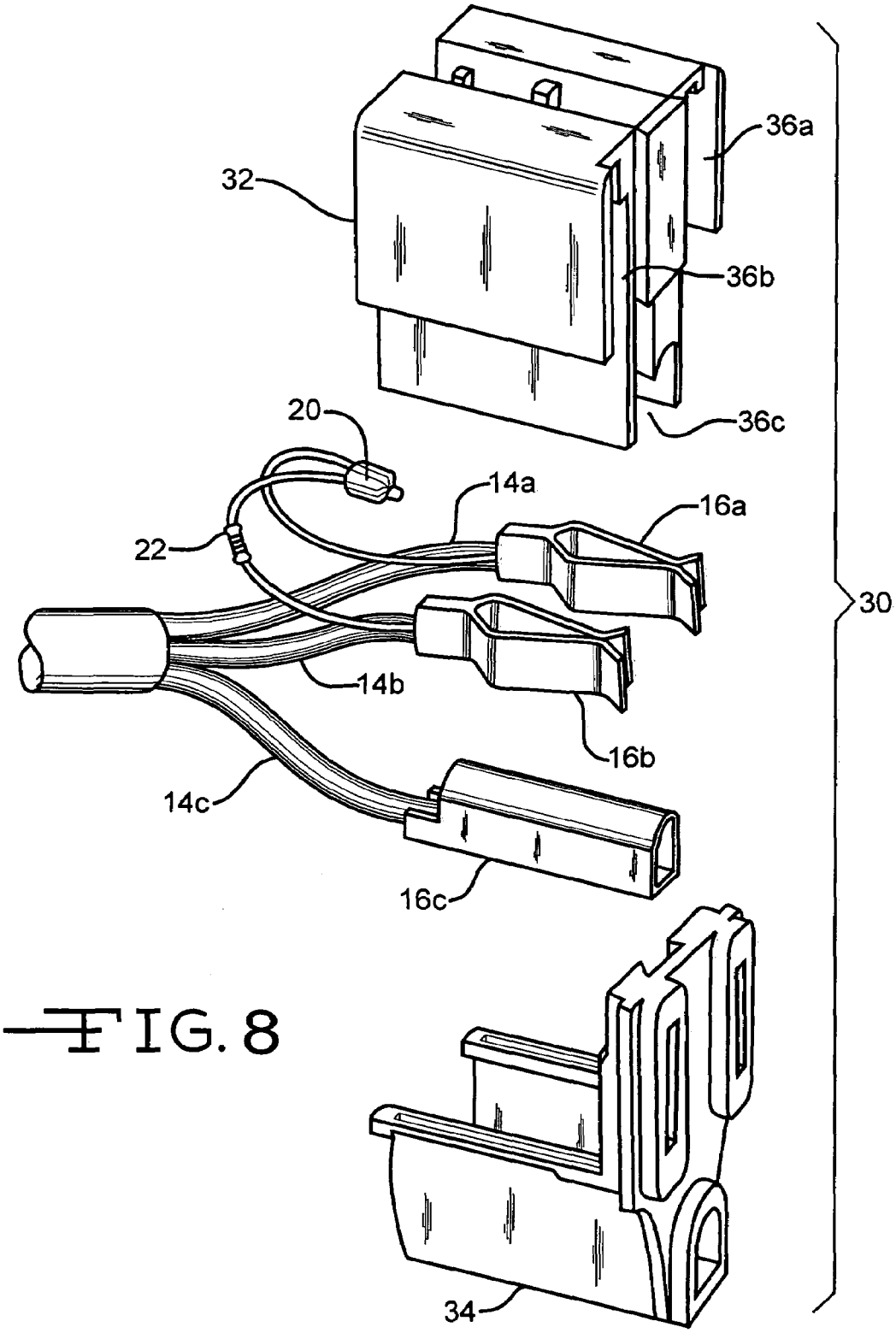
FIG. 8 presents an exploded pictorial of the component parts of one electrical outlet connector assembly as illustrated in FIG. 7.
Figure 9:
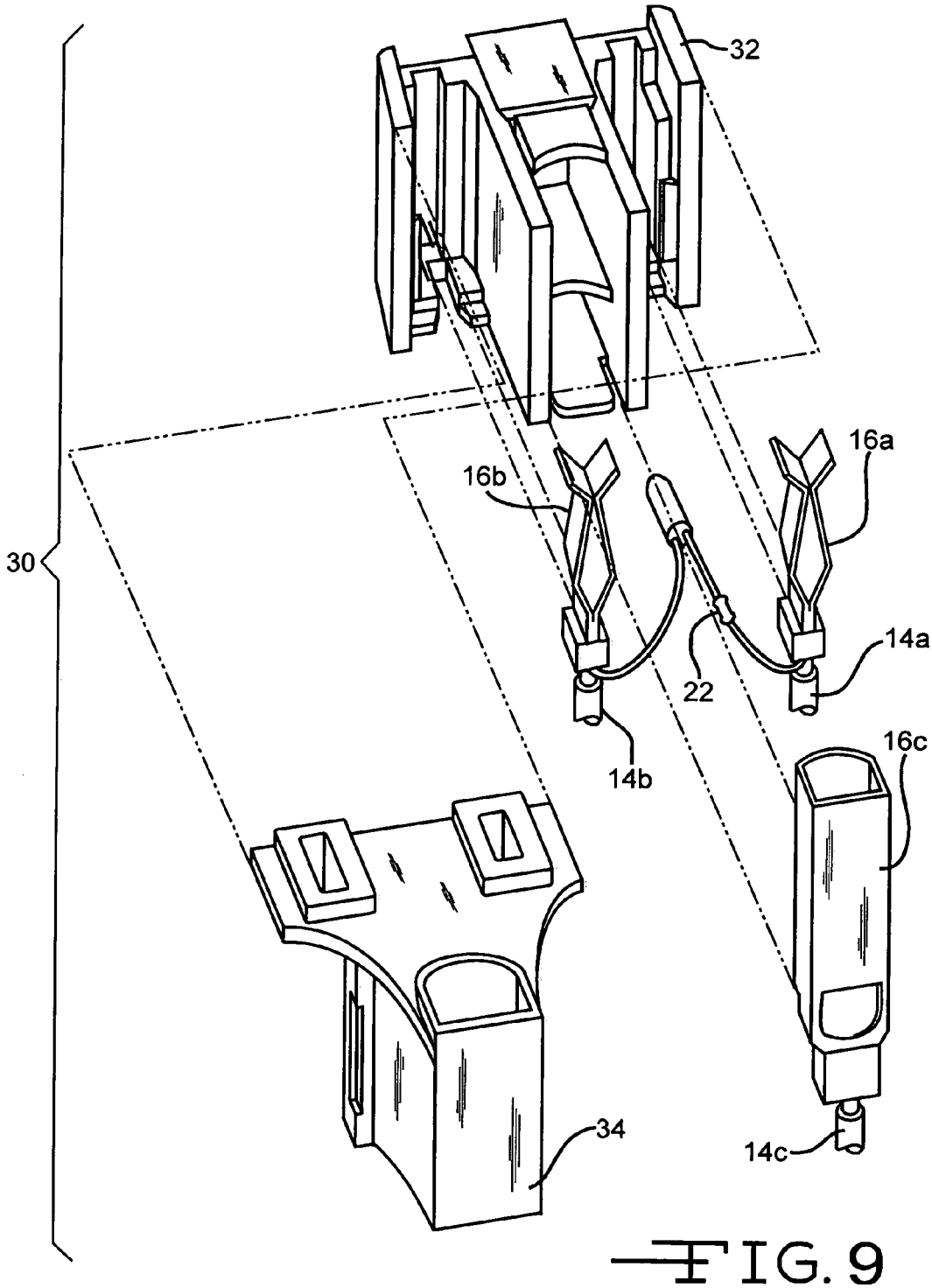
FIG. 9 presents an inverse exploded pictorial of the outlet connector assembly illustrated in FIGS. 7 and 8.
Figure 11:
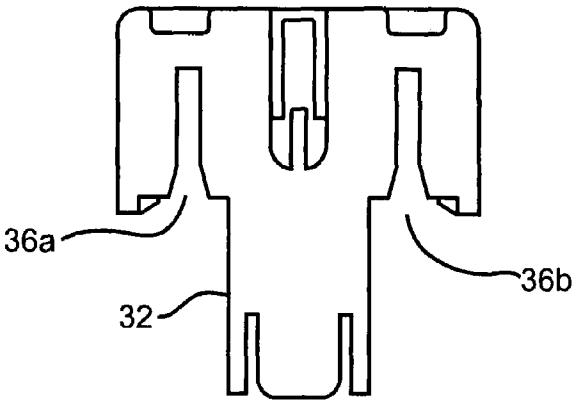
FIG. 11 presents a rear elevational view of the upper portion of the outlet connector assembly illustrated in FIGS. 8 and 9.
Figure 13:
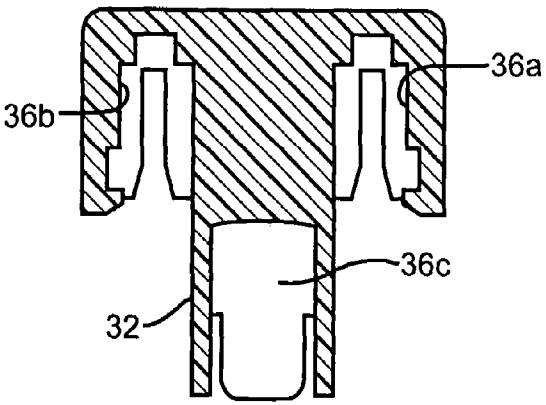
FIG. 13 present a crossectional view taken along line 13-13 in FIG. 12.
Figure 10:
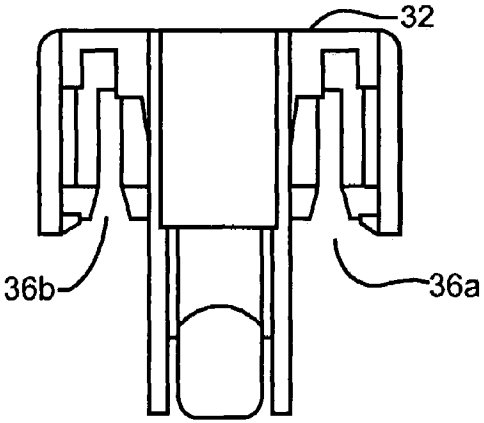
FIG. 10 presents a front elevational view of the upper portion of the outlet connector assembly illustrated in FIGS. 8 and 9.
Figure 12:
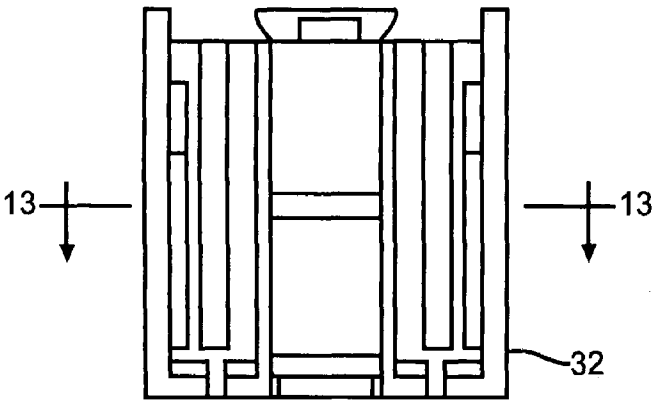
FIG. 12 presents a bottom view of the upper portion of the outlet connector assembly illustrated in FIG. 10.
Figure 14:
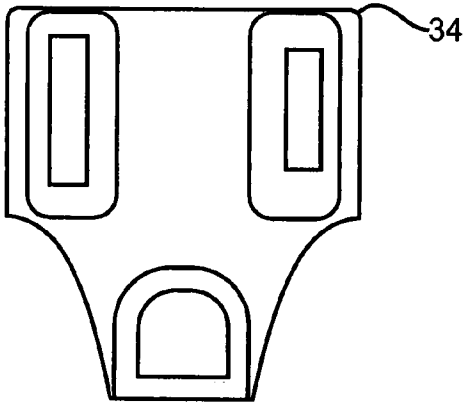
FIG. 14 presents a front elevational view of the lower portion of the outlet connector assembly illustrated in FIGS. 8 and 9.
Figure 15:
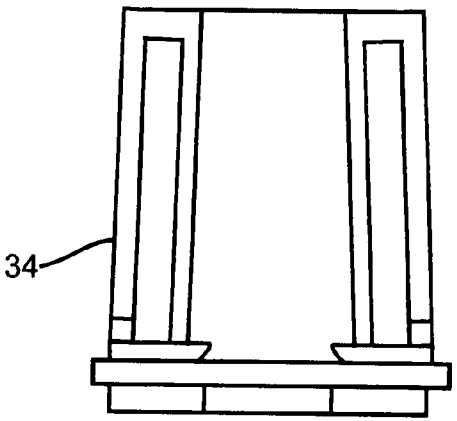
FIG. 15 presents top view of the lower portion of the outlet connector assembly illustrated in FIGS. 8 and 9.
Figure 16:
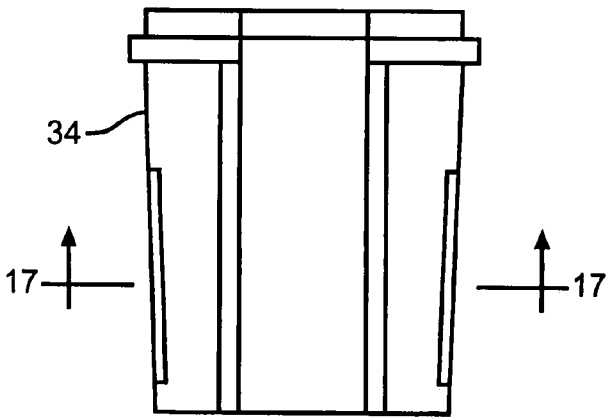
FIG. 16 presents the bottom view of the lower portion of the outlet connector assembly illustrated in FIG. 14.
Figure 17:
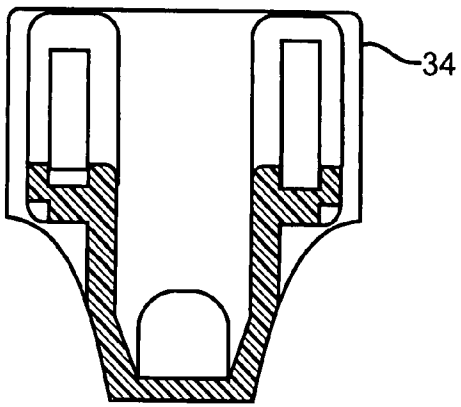
FIG. 17 presents a crossectional view taken along line 17-17 in FIG. 16.

Neon lamp 20 is connected to the hot 14*a* and common 14*b* electrical wires as illustrated in FIGS. 8 and 9. An amperage reducing resister 22 is provided between lamp 20 and hot wire 14*a*. Preferably lamp 20 is a NE-2H, neon lamp made by Multiway Industries having part number 50-1605-00200, and resister 22 is a typical ¼ watt, carbon film resister having a value of 30K Ohms and a tolerance of 10% or less.

An additional neon lamp 25, and its associated resister 28, is conveniently connected to electrical wires 14*a* and 14*b* as best illustrated in FIG. 5. Lamp 25 is positioned within center post 40 whereby lamp 40 will illuminate bore 42 when activated. A transparent, or translucent, plug or cap 55*a* and 55*b* is placed within the top and bottom opening of bore 42 thereby sealing lamp 25 therein.

Terminal connector assembly 30 basically comprises a unitary, molded upper component 32 and a unitary molded lower component 34. Upper component 32 includes two open ended cavities 36*a* receiving therein spade electrodes 16*a* and cavity 36*b* receiving therein spade electrode 16*b*. Appropriately positioned between cavities 36*a* and 36*b* is open ended cavity 36*c* receiving therein pin electrode 16*c*.

Lower component 34, of assembly 30, completes the assembly by receiving therein upper component 32 having electrodes 16*a*, 16*b*, 16*c* Upper and lower components, 32 and 34, snap together and may be held together by a "snap together locking mechanism," by a suitable adhesive, electron beam welding or any other convenient means.

After connector assemblies 30 are assembled, as illustrated in FIGS. 3 through 4, the entire assembly is encapsulated within a molded, clear or translucent, material as illustrated in FIG. 2.

Thus when the extension cord 18 is powered, light from neon lamps 20 and 25 will show through the molded body alerting the user that the extension and its electrical outlets are powered. If the material used to manufacture the upper and lower components 32 and 34 are colored, the reflected light from neon lamps 20 will reflect the associated color of light in each fingered outlet of multiple outlet assembly 10. Thus the connector outlet assembly 30 may be colored red, white, and blue if desired.

As an alternative, the molded body 12. of multiple outlet 10. may be encapsulated with an opaque material. In this type of embodiment there would be no need for neon lamps 20 within each connector assembly 30 and they may be omitted. However, neon lamp 25, within bore 42 of post 40, would remain as a lighted signal when extension cord 18 is powered While I have described above the principles of my invention in connection with specific embodiments, it is to be clearly understood that this description is made only by way of example and not as a limitation of the scope of my invention as set forth in the accompanying claims.

I claim:

1. An electrical power extension cord having electrical transmitting wires contained therein and terminating, at one end thereof, with a multi-ported electrical outlet assembly having at least two electrical outlets, wherein each said electrical outlet comprises a separate terminal receiving connector assembly incorporating therein individual connector electrodes separate and apart from adjacent electrical outlet assemblies, each of said connector electrodes separately connected to its appropriate electrical transmitting wire through a common junction, said common junction interposed between a lower plate and an upper plate, said upper plate and said lower plate having at least one post extending therebetween, said upper plate, said lower plate and said electrical outlet assemblies embedded within a molded translucent covering.

2. The electrical power extension cord as claimed in claim 1 wherein at least one of said terminal receiving connector assemblies include a lamp that is illuminated when said extension cord is powered.

3. The electrical power extension cord as claimed in claim 1 wherein said post is a hollow post and wherein said upper plate includes an opening there through aligned with said hollow post, and an electrically illuminated lamp, within said hollow post, that is illuminated when said electrical power extension cord is powered.

4. The electrical power extension cord as claimed in claim 3 wherein said molded covering includes a translucent area, aligned with said cylindrical post, whereby light emitted from said lamp may pass there through.

5. An electric power extension cord having electrical transmitting wires contained therein and terminating at one end thereof with a multi-ported electrical outlet assembly having at least two electrical outlets wherein each said electrical outlet includes a separate terminal receiving connector assembly wherein each connector assembly comprises:

a) an upper molded component and, b) a lower molded component, c) said upper and lower components joined together thereby forming said connector assembly receiving therein connector electrodes, each of said connector electrodes electrically connected to its appropriate electrical transmitting wire, said multi-ported electrical outlet assembly embedded within a molded covering of translucent material, wherein a lamp is affixed at least one of said connector components and electrically connected to said connector electrodes such that when said extension cord is electrically powered said lamp is illuminated and the light reflected from said connector components is reflected as colored light having the color of said connector components.

6. The electric power extension cord as claimed in claim 5 wherein said connector components are made from a color reflecting material.

* * * * *